US008770170B2

(12) United States Patent
Mulay et al.

(10) Patent No.: US 8,770,170 B2
(45) Date of Patent: Jul. 8, 2014

(54) BEDPLATE ASSEMBLY AND METHOD

(75) Inventors: Pururawa A Mulay, Novi, MI (US); Allen G. Sheppard, St. Catharines (CA); Dean Lee Weed, Waterford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 309 days.

(21) Appl. No.: 13/343,022

(22) Filed: Jan. 4, 2012

(65) Prior Publication Data

US 2013/0167800 A1 Jul. 4, 2013

(51) Int. Cl.
*F02F 7/00* (2006.01)
*B21K 3/00* (2006.01)

(52) U.S. Cl.
USPC ..... 123/195 R; 29/888.01; 164/340

(58) Field of Classification Search
CPC ..... B23P 19/042; B23P 19/043; B21K 1/26; B21K 3/00; F02F 7/0007; F02F 7/0008; F02F 7/0053; F02F 7/0021; F02F 2007/0056; F02F 7/0029; F02F 7/0085
USPC ..... 123/195 R, 195 H; 29/888.01; 164/340, 164/368
See application file for complete search history.

(56) References Cited

U.S. PATENT DOCUMENTS

| | | | | |
|---|---|---|---|---|
| 6,192,852 | B1 * | 2/2001 | Gerhards et al. | 123/195 R |
| 6,675,763 | B1 * | 1/2004 | Ratzi et al. | 123/195 R |
| 2011/0318096 | A1 * | 12/2011 | Lausch | 123/195 R |

FOREIGN PATENT DOCUMENTS

| | | | |
|---|---|---|---|
| DE | 19640719 | C1 * | 10/1997 |
| EP | 184029 | A2 * | 10/2007 |

* cited by examiner

*Primary Examiner* — Noah Kamen
(74) *Attorney, Agent, or Firm* — Quinn Law Group, PLLC

(57) ABSTRACT

A method of constructing a bedplate assembly for retention of a crankshaft in an internal combustion engine having an engine block includes forming a bedplate insert in a first pattern tool. The bedplate insert is defined by a height, a width, and a thickness. The bedplate insert also includes a shape having a variation in the width along the height. The method also includes arranging the formed bedplate insert in a second pattern tool. The method additionally includes forming in the second pattern tool a bedplate frame around the formed bedplate insert to generate the bedplate assembly. During forming of the bedplate frame, the variation in the width of the bedplate insert generates an internal rib in the bedplate frame that is configured to fix and retain the bedplate insert inside the bedplate frame and decrease deflection of the bedplate frame under crankshaft loads during operation of the engine.

11 Claims, 5 Drawing Sheets

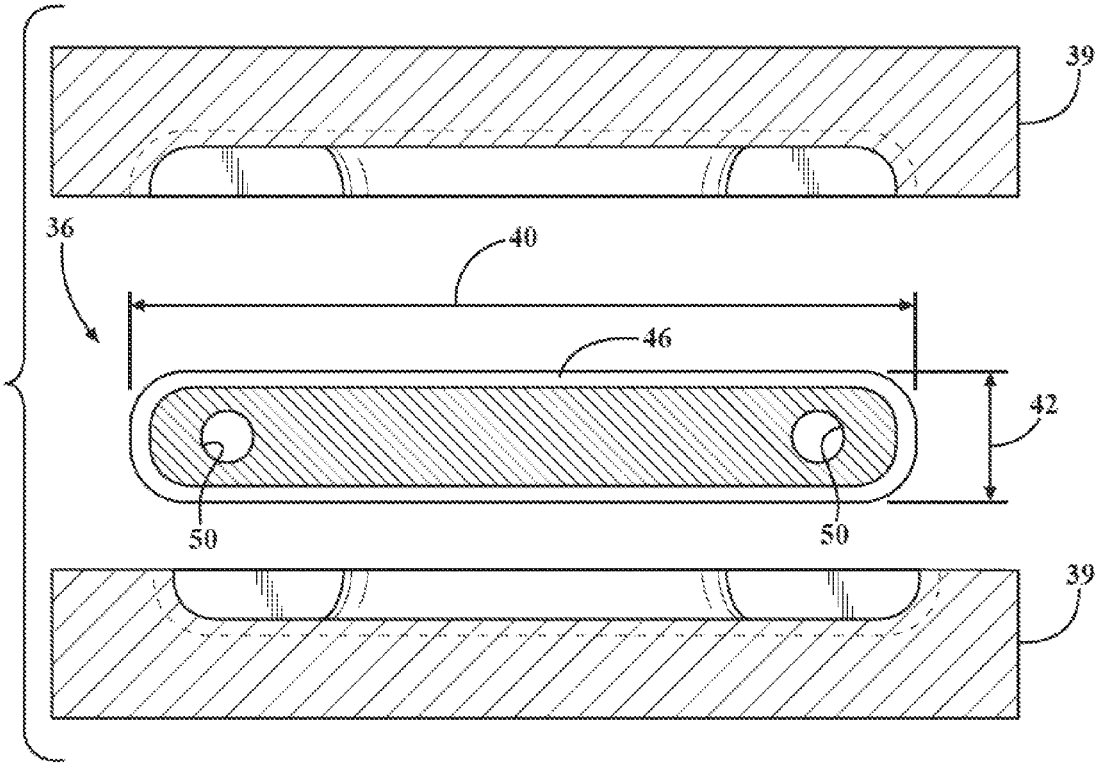
FIG. 4
FIG. 6
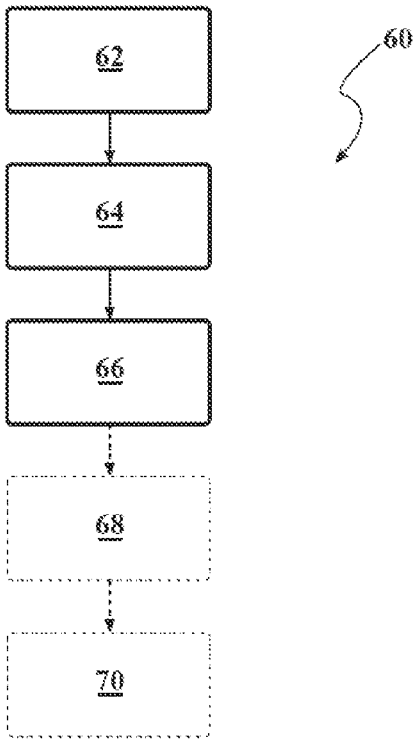

BEDPLATE ASSEMBLY AND METHOD

TECHNICAL FIELD

The present disclosure relates to a bedplate assembly for an internal combustion engine and a method of manufacturing same.

BACKGROUND

Internal combustion engines (ICE) are often called upon to generate considerable levels of power for prolonged periods of time on a dependable basis. In order to achieve such dependable engine operation, many such ICE assemblies employ a bedplate to rotatably support the engine's crankshaft and affect retention thereof to the engine's cylinder block.

The bedplate is a structural member that typically incorporates crankshaft bearing supports and includes a perimeter wall with transverse webbings and intersecting ribs to withstand engine vibrations. As such, a bedplate is generally employed in place of individual bearing supports or caps for improved durability and quiet operation of a particular engine at elevated operating loads and rotational speeds.

SUMMARY

One embodiment of the disclosure is directed to a method of constructing a bedplate assembly for retention of a crankshaft in an internal combustion engine having an engine block. The method includes forming a bedplate insert in a first pattern tool. The bedplate insert is defined by an insert height, an insert width, and an insert thickness. The bedplate insert also includes a shape having a variation in the insert width along the insert height. The method also includes arranging the formed bedplate insert in a second pattern tool. The method additionally includes forming or over-molding in the second pattern tool a bedplate frame around the formed bedplate insert to generate the bedplate assembly. During forming of the bedplate frame, the variation in the insert width of the bedplate insert generates an internal rib in the bedplate frame that is configured to fix and retain the bedplate insert inside the bedplate frame and increase stiffness of the bedplate frame. Such increased stiffness in turn decreases deflection of the bedplate frame under crankshaft loads during operation of the engine.

The variation in the insert width may be part of a trough extending around at least a portion of the perimeter of the bedplate insert.

The act of forming the bedplate insert may include casting the insert from a ferrous alloy. In such a case, the ferrous alloy may be a nodular iron.

The act of forming the bedplate frame may include casting the frame from a non-ferrous alloy. In such a case, the non-ferrous alloy may be one of aluminum and magnesium.

The method may also include machining the generated bedplate assembly to achieve a precision fit between the bedplate assembly and the engine block.

The method may additionally include forming at least two bolt passages in the bedplate insert along the insert height for subsequent attachment of the bedplate assembly via respective bolts to the engine block in order to affect crankshaft retention.

The method may additionally include mounting a bearing on the bedplate insert in order to rotatably support the crankshaft against the engine block.

Another embodiment of the invention is directed to an internal combustion engine having the bedplate assembly described above.

The above features and advantages, and other features and advantages of the present disclosure, will be readily apparent from the following detailed description of the embodiment(s) and best mode(s) for carrying out the described invention when taken in connection with the accompanying drawings and appended claims.

BRIEF DESCRIPTION OF THE DRAWINGS

FIG. 4 is a schematic exploded cross-sectional view of the bedplate insert shown in FIG. 3.

FIG. 6 is a flow chart illustrating a method of constructing the bedplate assembly shown in FIGS. 2-5 for retention of a crankshaft in the internal combustion engine depicted in FIGS. 1-2.

DETAILED DESCRIPTION

Figure 1:
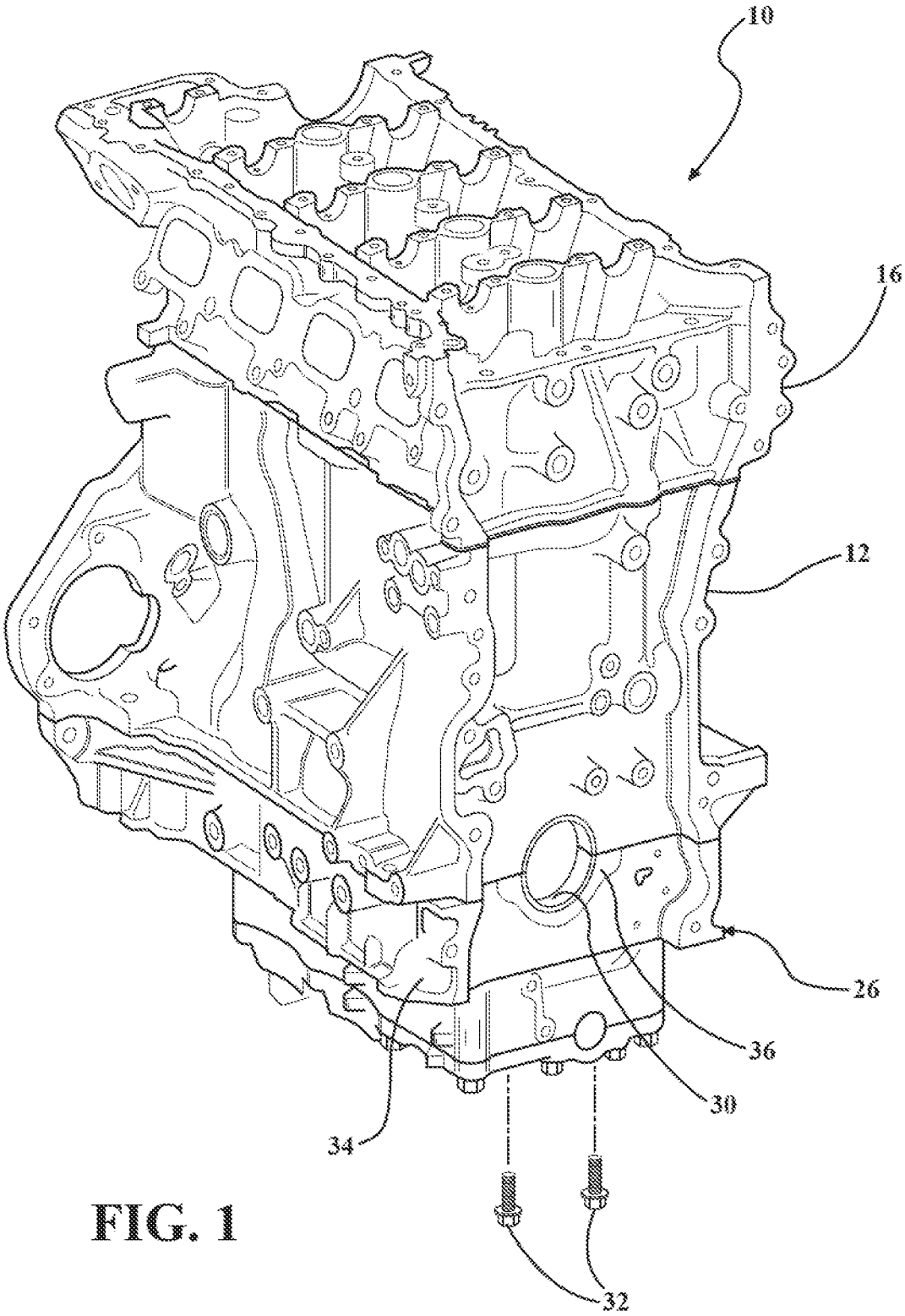
FIG. 1 is a schematic perspective view of an internal combustion engine having a bedplate assembly according to the disclosure.
Figure 2:
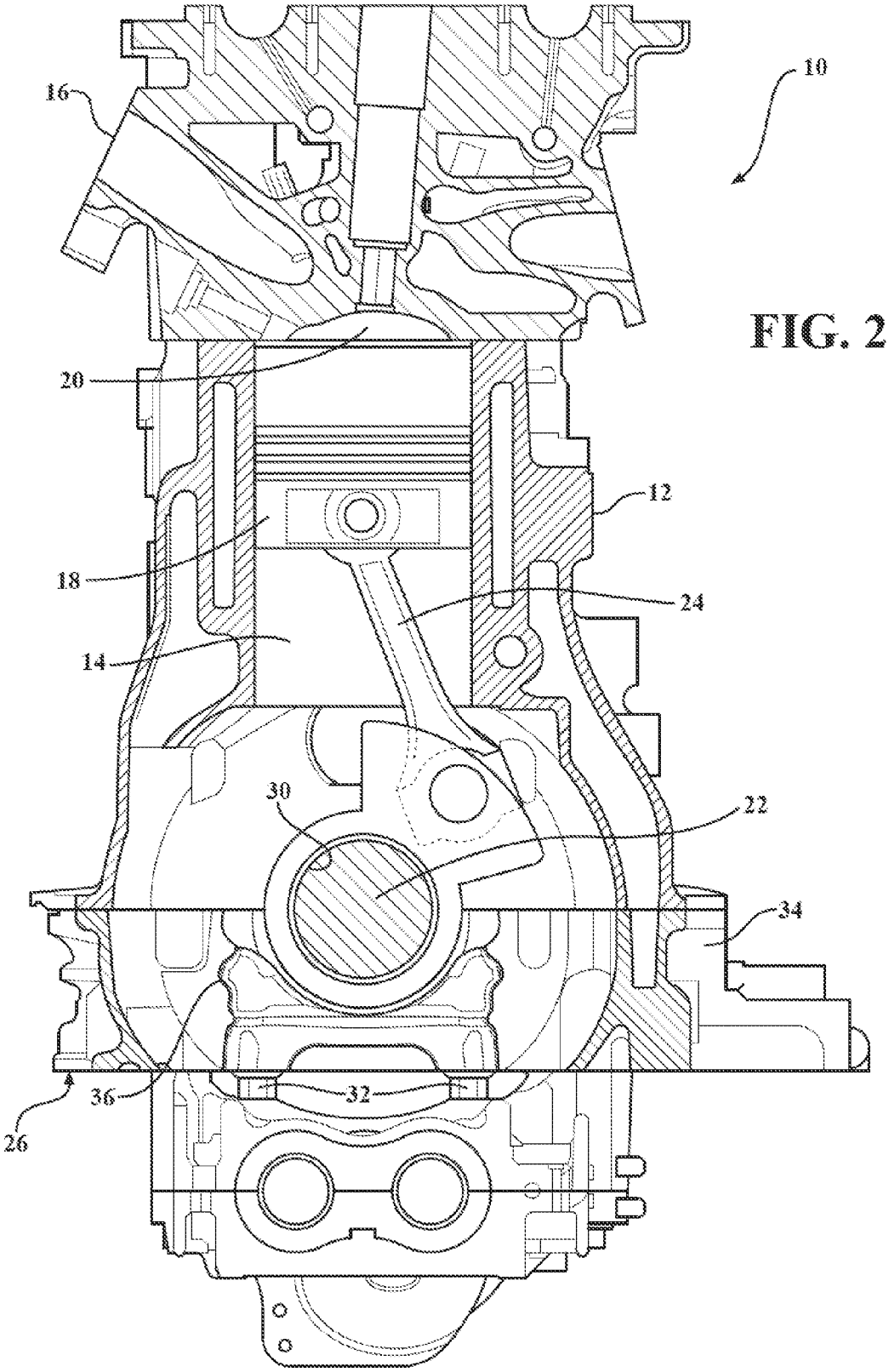
FIG. 2 is a schematic cross-sectional view of the engine shown in FIG. 1.

Referring to the drawings wherein like reference numbers correspond to like or similar components throughout the several figures, FIGS. 1-2 illustrate an internal combustion engine 10. The engine 10 also includes an engine or cylinder block 12 with a plurality of cylinders 14 arranged therein. As shown, the engine 10 also includes a cylinder head 16. Each cylinder 14 includes a piston 18 configured to reciprocate therein.

As may be seen in FIG. 2, combustion chambers 20 are formed within the cylinders 14 between the bottom surface of the cylinder head 16 and the tops of the pistons 18. As known by those skilled in the art, combustion chambers 20 are configured to receive a fuel-air mixture for subsequent combustion therein. The engine 10 also includes a crankshaft 22 configured to rotate with respect to the cylinder block 12. The crankshaft 22 is rotated by the pistons 18 acting through connecting rods 24 as a result of an appropriately proportioned fuel-air mixture being burned in the combustion chambers 20. After the air-fuel mixture is burned inside a specific combustion chamber 20, the reciprocating motion of a particular piston 18 serves to exhaust post-combustion gases from the respective cylinder 14.

As shown in FIGS. 1-2, the engine 10 also includes a bedplate assembly 26. The bedplate assembly 26 is a structural member configured to support the crankshaft 22 and retain the crankshaft against the engine block 12. The bedplate assembly 26 includes transverse webbings and intersecting ribs (not shown) to withstand various engine loads. The engine 10 additionally includes bearings 30 that are fixed by the bedplate assembly 26 against the cylinder block 12 and are configured to rotatably support the crankshaft 22 against the engine block 12. Bearings 30 may be formed from an appropriate low friction material such as bronze and are configured to retain a hydrodynamic film of engine oil, which in turn supports journals of the crankshaft 22 when the engine 10 is running.

Bolts 32 attach the bedplate assembly 26 to the engine block 12 and are configured to withstand loads transmitted through the crankshaft during operation of the engine 10. Such loads may be the result of various forces as a result of combustion, as well as the mass and imbalance of individual components of the rotating assembly which includes the pistons 18, the crankshaft 22, and the connecting rods 24. Accordingly, because the bolts 32 connect the bedplate assembly 26 to the engine block 12, such crankshaft loads are distributed through the bolts 32 between the bedplate assembly and the engine block.

To withstand the above described crankshaft loads, the bedplate assembly 26 includes a bedplate frame 34 and a plurality of bedplate inserts 36 incorporated therein. The bedplate frame 34 may be formed from a non-ferrous alloy, such as aluminum or magnesium, for such materials' combination of strength and relatively low mass. Accordingly, the bedplate frame 34 may be manufactured via a casting process. The bedplate inserts 36 may be formed from a ferrous alloy, such as nodular iron or steel, for such material's stiffness and strength. As such, the bedplate inserts 36 may be manufactured via a casting or forging process, or be machined from a billet.

Figure 3:
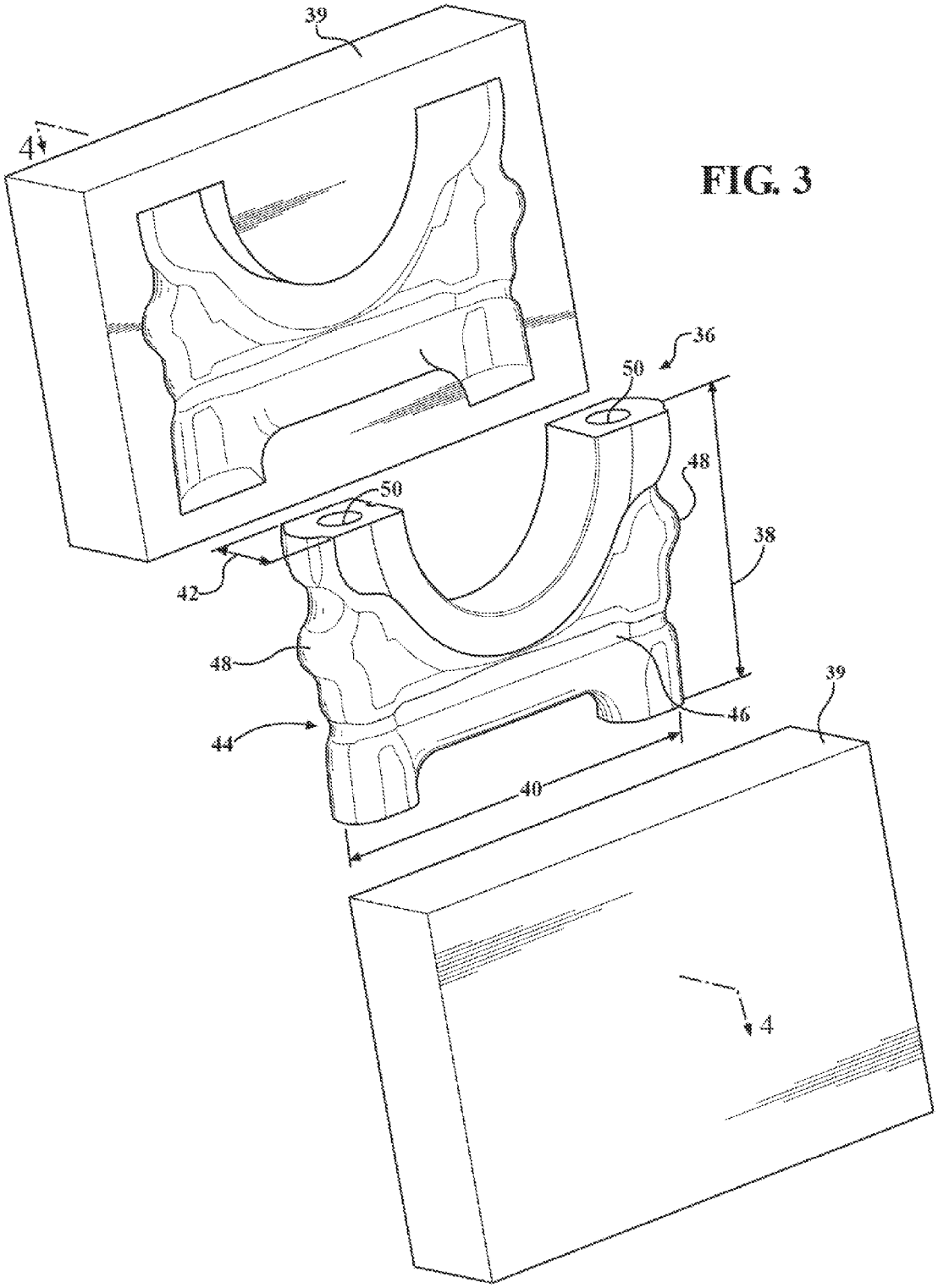
FIG. 3 is a schematic exploded perspective view of a bedplate insert for the bedplate assembly shown in FIGS. 1-2.

As shown in FIG. 3, the bedplate insert 36 is defined by an insert height 38, an insert width 40, and an insert thickness 42. The bedplate insert 36 is additionally defined by a shape having a variation 44 in the insert width 40 along the insert height 38. The variation 44 may be part of a trough 46 extending around at least a portion of the perimeter of the bedplate insert 36, as may be seen in the cross-section 4-4 depicted in FIG. 4. The bedplate insert 36 may additionally include projections 48, as shown in FIG. 3, to aid in retention of the bedplate insert inside the bedplate frame 34 in the final bedplate assembly 26. Thus, the variation 44 alongside the projections 48 generates a non-uniform outer surface in the insert width 40 of the bedplate insert 36.

With continued reference to FIG. 3, the bedplate insert 36 may be formed in a first pattern tool 39. The variation 44 may be cast into the bedplate insert 36, be machined, or otherwise added to a previously formed bedplate insert. As shown in both FIGS. 3 and 4, the bedplate insert 36 also includes bolt passages 50 that are either formed or machined along the insert height 38 for accepting the bolts 32. Accordingly, the bolt passages 50 may be used for attachment of the bedplate assembly 26 to the engine block 12 to affect retention of the crankshaft 22.

Figure 5:
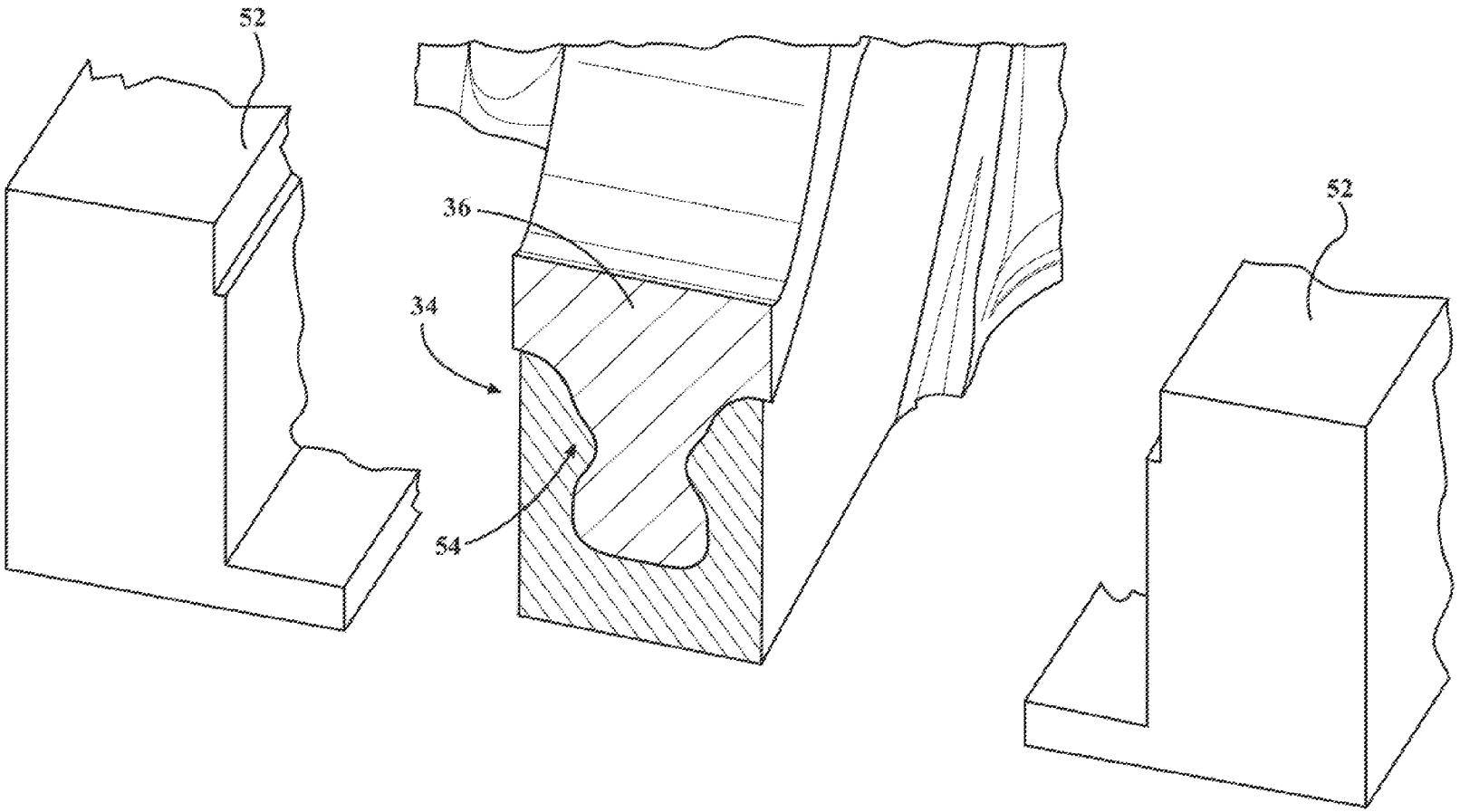
FIG. 5 is a schematic exploded perspective view of a bedplate frame being formed around the bedplate insert shown in FIGS. 3-4 to generate the bedplate assembly shown in FIG. 1.

As shown in FIG. 5, the bedplate frame 34 may be formed or over-molded in a second pattern tool 52 around the formed bedplate insert 36 after the bedplate insert is arranged in the second pattern tool. Accordingly, during forming of the bedplate frame 34, the variation 44 in the insert width 40 generates an internal rib 54 in the bedplate frame 34. The internal rib 54 is configured to fix and retain the bedplate insert 36 inside the bedplate frame 34. Additionally, the internal rib 54 increases stiffness of the bedplate frame 34 to thereby decrease deflection of the bedplate frame under crankshaft loads during operation of the engine 10.

Following the forming of the bedplate frame 34 around the bedplate inserts 36, at least a portion of one of the bearings 30 is fixed to each respective bedplate insert 36 to complete the formed bedplate assembly 26. Additionally, the bedplate assembly 26 may be machined to achieve a precision fit between the bedplate assembly and the engine block 12 after the bedplate frame 34 has been formed around the bedplate inserts 36. Such additional machining of the bedplate assembly 26 serves to locate the crankshaft 22 with respect to the engine block 12 so as to facilitate accurate assembly and reliable operation of the engine 10.

FIG. 6 depicts a method 60 of constructing the bedplate assembly 26 for the engine 10. The method commences in frame 62 with forming the bedplate inserts 36 in the first pattern tool 39. The first pattern tool 39 includes an inner surface that defines the shape having the variation 44 and may additionally define projections 48. Following frame 62, the method proceeds to frame 64. In frame 64, the method includes arranging the formed bedplate inserts 36 in the second pattern tool 52.

After frame 64, the method advances to frame 66. In frame 66, the method includes forming in the second pattern tool 52 the bedplate frame 34 around the formed bedplate inserts 36 to generate the bedplate assembly 26. As described above with respect to FIGS. 1-4, during forming of the bedplate frame 34 the variation in the insert width 40 of each respective bedplate insert 36 generates an internal rib 54 in the bedplate frame 34. As additionally noted above, the internal rib 54 is configured to fix and retain the bedplate insert inside the bedplate frame and by increasing stiffness of the bedplate frame 34, decreases deflection of the bedplate frame under crankshaft loads during operation of the engine 10.

Either in frame 62, or following frame 62 or frame 66, the method may include forming at least two bolt passages 50 in the bedplate insert 36 along the insert height 38 for subsequent attachment of the bedplate assembly 26 via the bolts 32 to the engine block 12. Following frame 66, the method may advance to frame 68. In frame 68 the method may include machining the generated bedplate assembly 26 to achieve a precision fit between the bedplate assembly and the engine block 12. Additionally, after frame 68, the method may proceed to frame 70, where the method may include mounting bearings 30 on the bedplate inserts 36 in order to rotatably support the crankshaft 22 against the engine block 12.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A method of constructing a bedplate assembly for retention of a crankshaft in an internal combustion engine having an engine block, the method comprising:

forming a bedplate insert in a first pattern tool, wherein the bedplate insert is defined by an insert height, an insert width, and an insert thickness, the bedplate insert has a shape with a variation in the insert width along the insert height, and wherein the first pattern tool defines the variation in the insert width;

arranging the formed bedplate insert in a second pattern tool; and forming in the second pattern tool a bedplate frame around the formed bedplate insert to generate the bedplate assembly, wherein during forming of the bedplate frame the variation in the insert width of the bedplate insert generates an internal rib in the bedplate frame that is configured to fix and retain the bedplate insert inside the bedplate frame and decrease deflection of the bedplate frame under crankshaft loads during operation of the engine.

2. The method of claim 1, wherein the variation in the insert width is part of a trough extending around at least a portion of the perimeter of the bedplate insert.

3. The method of claim 2, wherein the trough extends around the entire perimeter of the bedplate insert.

4. The method of claim 1, wherein said forming the bedplate insert includes casting the insert from a ferrous alloy.

5. The method of claim 4, wherein the ferrous alloy is a nodular iron.

6. The method of claim 1, wherein said forming the bedplate frame includes casting the frame from a non-ferrous alloy.

7. The method of claim 6, wherein the non-ferrous alloy is one of aluminum and magnesium.

8. The method of claim 1, further comprising machining the generated bedplate assembly to achieve a precision fit between the bedplate assembly and the engine block.

9. The method of claim 1, further comprising forming at least two bolt passages in the bedplate insert along the insert height for subsequent attachment of the bedplate assembly via respective bolts to the engine block to affect retention of the crankshaft relative to the engine block.

10. The method of claim 1, further comprising mounting a bearing on the bedplate insert, wherein the bearing is configured to rotatably support the crankshaft against the engine block.

11. The method of claim 1, wherein the shape of the bedplate insert additionally includes projections arranged along the insert height, extending out from the insert width, and configured to aid retention of the bedplate insert inside the bedplate frame, and wherein the first pattern tool defines the projections.

* * * * *